US007146939B2

(12) United States Patent
Azevedo

(10) Patent No.: US 7,146,939 B2
(45) Date of Patent: Dec. 12, 2006

(54) ANTI-CAVITATION DIESEL CYLINDER LINER

(75) Inventor: Miguel Azevedo, Ann Arbor, MI (US)

(73) Assignee: Federal-Mogul Worldwide, Inc., Southfield, MI (US)

( * ) Notice: Subject to any disclaimer, the term of this patent is extended or adjusted under 35 U.S.C. 154(b) by 0 days.

(21) Appl. No.: 11/225,523

(22) Filed: Sep. 13, 2005

(65) Prior Publication Data

US 2006/0249105 A1 Nov. 9, 2006

Related U.S. Application Data

(60) Provisional application No. 60/609,906, filed on Sep. 14, 2004.

(51) Int. Cl.
*F02F 1/10* (2006.01)

(52) U.S. Cl. ..... 123/41.84

(58) Field of Classification Search ..... 123/41.81, 123/41.83, 41.84
See application file for complete search history.

*Primary Examiner*—Noah P. Kamen

(74) *Attorney, Agent, or Firm*—Robert L. Stearns; Dickinson Wright PLLC

(57) ABSTRACT

A wet-style cylinder liner (16) for a diesel engine is provided with a surface texture (28) to combat the effects of cavitation-induced erosion. The surface texture (28) can be formed as a coating (30) of manganese phosphate applied about the outer surface (26) of the cylinder liner (16) within the coolant flow passage (20) of the engine. The manganese phosphate is applied in such a manner that a crystalline structure of 2–8 μm average grain size, blocky in nature, clearly faceted, with no cauliflower-like formations and a discernable channel network surrounding the crystals is formed. This crystalline structure works with the natural adhesion and surface tension effects within the liquid coolant to create a stagnant fluid layer about the outer surface (26) of the cylinder liner (16). The stagnant fluid layer functions like a self-healing armor plate. When rapid flexing of the cylinder liner (16) produces cavitation bubbles, these bubbles are held at a distance from the outer surface (26) by the stagnant fluid layer. As the bubbles implode, their kinetic energy is dissipated within the stagnant fluid layer instead of directly upon the outer surface (26) of the cylinder liner (16). The manganese phosphate coating (30) acts as a labyrinth to anchor water molecules, or the engine coolant, and thus promote formation of the stagnant fluid layer.

10 Claims, 4 Drawing Sheets

ANTI-CAVITATION DIESEL CYLINDER LINER

CROSS-REFERENCE TO RELATED APPLICATIONS

This application claims priority to U.S. Provisional Application No. 60/609,906 filed Sep. 14, 2004.

BACKGROUND OF THE INVENTION

1. Technical Field

The subject invention relates to a cylinder liner for a diesel engine of the type forming a combustion chamber in cooperation with a reciprocating piston, and more particularly to a diesel cylinder liner having a surface treatment designed to overcome the destructive effects of cavitation-induced erosion.

2. Related Art

Most heavy-duty diesel engines have wet sleeve cylinder liners which allow coolant to circulate on the outside of the cylinders to effectively dissipate heat. These wet sleeve liners are susceptible to a failure mechanism known as cavitation erosion.

Cavitation is a localized low-pressure zone that forms along the outer wall of a cylinder liner. It is caused by the flexing of the cylinder wall due to the high cylinder pressures experienced in diesel engine ignition. During combustion, the cylinder wall quickly expands and then returns to its original geometry. Cylinder wall expansion is more pronounced as the demand for power increases due to increased cylinder pressures. On a microscopic level, inward cylinder wall movement causes a low pressure zone to be created in the coolant adjacent to the cylinder wall. When the pressure zone drops below the vapor pressure point of the coolant, a vapor bubble is formed. When this low pressure zone returns to a high pressure zone, the vapor bubble collapses causing an implosion which results in pitting on the cylinder wall. This pitting, if left unchecked, can compromise the integrity of the cylinder liner.

One prior art attempt to prevent or reduce the phenomenon of cavitation and the resultant pitting, consists of formulating special coolants containing additives. Broadly, these additives fall into two categories: those based upon a borade or nitrite salt, and those formulated from an organic chemistry compound (carboxcylic/fatty acids). The former group works on the principle of reducing the surface tension of the coolant, which lowers the peak pressure reached within the bubble and provides for a "soft" implosion. The coolant solutions formulated from organic chemistry compounds also reduce surface tension, and in addition coat the liner's outer surface with a sacrificial layer of compounds which are continuously renewed by the chemistry make-up of the coolant.

Such specially formulated coolants, while moderately effective at controlling cavitation-induced erosion, are expensive and not always readily available. For example, if a service technician does not have a coolant with these special additives in ready supply, it is likely that any coolant and/or water will be used for the sake of expediency.

Accordingly, there is a need for an improved method of controlling cavitation-induced erosion which does not depend upon the availability of expensive, specially formulated coolants.

Another attempt to protect wet cylinder liners from cavitation-induced erosion operates on the principle of plating, or otherwise fortifying, the outer surface of the liner so that it is better able to withstand attack from imploding bubbles. For example, nickel and nickel-chromium electroplating have been used in the past. Other surface treatments and jacketing techniques have also been proposed to enable a liner to withstand cavitation erosion. These prior art strategies add substantial cost and complexity to the liner manufacturing operations. In many cases, they substantially increase the weight of the liner, or introduce some other ancillary negative effects. Accordingly, there is a need for alternative solutions to corrosion-induced erosion which do not significantly increase the expense of a diesel engine overhaul.

SUMMARY OF THE INVENTION

According to a first aspect of the invention, a cylinder liner for a liquid-cooled internal combustion engine comprises a tubular body having a generally cylindrical bore adapted for receiving a reciprocating piston and forming a portion of the chamber in which the thermal energy of a combustion process is converted into mechanical energy. The cylinder liner includes an upper end and a lower end. An outer surface generally envelopes the tubular body and extends between the upper and lower ends. At least a portion of the outer surface is adapted for direct contact with a liquid cooling medium to transfer heat energy from the liner into the liquid cooling medium. At least a portion of the outer surface includes a surface texture consisting essentially of blocky particles having an average size of 2–8 μm, the particles each being faceted and surrounded by a channel network. The surface texture is effective to create a thin, stagnant layer of liquid which effectively adheres to the outer surface of the cylinder liner. This thin, stagnant layer of coolant operates as an integral, renewable shield which absorbs the implosion energy from the collapsing bubbles and then is quickly healed.

According to a second aspect of the invention, a liquid-cooled cylinder block for an internal combustion engine comprise a crank case including a coolant flow passage. The cylinder liner is disposed in the crank case and has a generally tubular body defining a generally cylindrical bore extending between upper and lower ends. The body of the cylinder liner includes an outer surface at least partially exposed to the coolant flow passage for transferring heat energy from the liner to liquid cooling medium flowing in the coolant flow passage. At least a portion of the outer surface which is in the coolant flow passage includes a surface texture consisting essentially of blocky particles having an average size of 2–8 μm. The particles are each faceted and surrounded by a channel network capable of creating a thin stagnant layer of liquid adherent to the outer surface of the liner.

Adhesion and surface tension affects characteristic of cooling mediums, particularly those which are polar in nature, are coupled and treated as capillary action. Thus, after the stagnant layer is created, the bubbles resulting from cavitation will be held away from the outer surface of the cylinder liner. Moreover, the impinging jet from imploding cavities will have a longer path to travel and will have to overcome the tenacious film formed by the stagnant fluid layer. Thus, the stagnant layer forms a shield to rapidly dissipate the incoming high kinetic energy by imploding bubbles.

The novel surface texture of the subject invention provides cavitation-induced erosion protection for a wide variety of liquid cooling medium, both common and specially formulated. The novel surface texture is easily created with common materials and processes.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
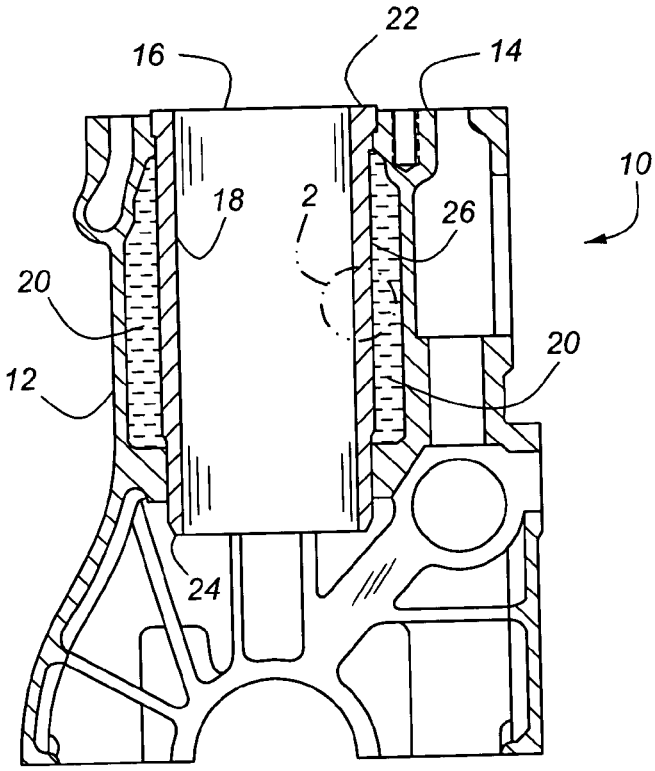
FIG. 1 is a simplified cross-sectional view of a liquid-cooled cylinder block for an internal combustion engine including a crank case and a wet cylinder liner disposed therein.

Referring to the Figures wherein like numerals indicate like or corresponding parts throughout the several views, a liquid-cooled cylinder block for an internal combustion engine is generally shown at 10 in FIG. 1. The cylinder block 10 is largely composed of a crank case 12 typically cast from iron or aluminum. The crank case 12 includes a head surface 14 adapted to receive a head gasket (not shown). A cylinder liner, generally indicated at 16, is fitted into the crank case 12 so that, when fully assembled, a reciprocating piston (not shown) can slide within a generally cylindrical bore 18 and form a portion of the chamber in which the thermal energy of a combustion process is converted into mechanical energy. An intentional space between the cylinder liner 16 and the crank case 12 forms a coolant flow passage 20 through which a liquid cooling medium is circulated for the purpose of removing heat energy from the cylinder liner 16. The cylinder liner 16 is defined by a tubular body having an upper end 22 associated with the head surface 14, and a lower end 24 which opens toward a crank shaft (not shown) rotably carried in the crank case 12. The cylinder liner 16 includes an outer surface 26 which is fixed at its upper and lower ends to the crank case 12. Between these fixation points, the outer surface 26 is exposed to the coolant flow passage 20 for convective heat transfer through the flowing liquid cooling medium circulated within the coolant flow passage 20.

Figure 2:
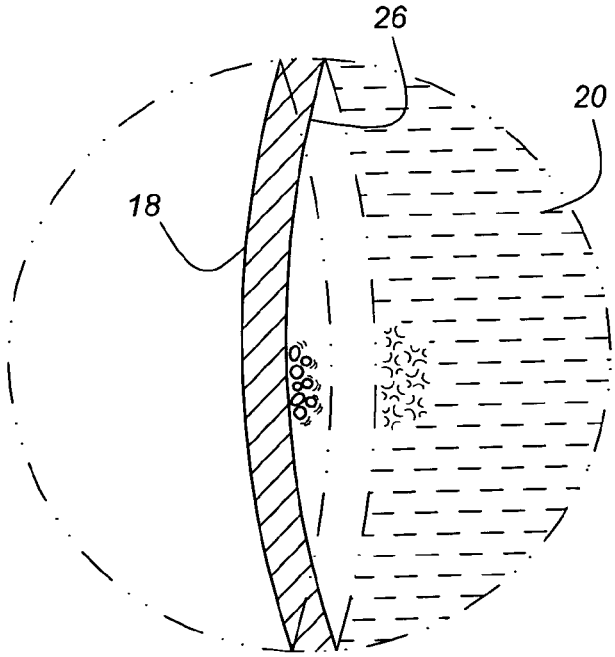
FIG. 2 is an enlarged view of the area circumscribed at 2 in FIG. 1, showing, in exaggerated fashion, the formation of cavitation bubbles on the outer surface of a cylinder liner due to flexing of the wall.

During normal engine operation, and particularly during high load conditions, the unsupported sections of the cylinder liner, i.e., the portions of the tubular body exposed to the coolant flow passage 20, undergo flexing caused by pressure fluxuations inside the bore 18. This flexing, which is illustrated in an exaggerated fashion in FIG. 2, causes liquid coolant adjacent to the outer surface 26 to cycle through low and high pressure zones. When the low pressure stage drops below the vapor pressure point of the liquid coolant, a vapor bubble is formed and then quickly collapses as the tubular body expands. This occurs at extremely high frequency and induces very high temperatures which result in pitting of the metal substrate. Cavitation induced pitting can eventually puncture through the liner thickness.

Figure 3:
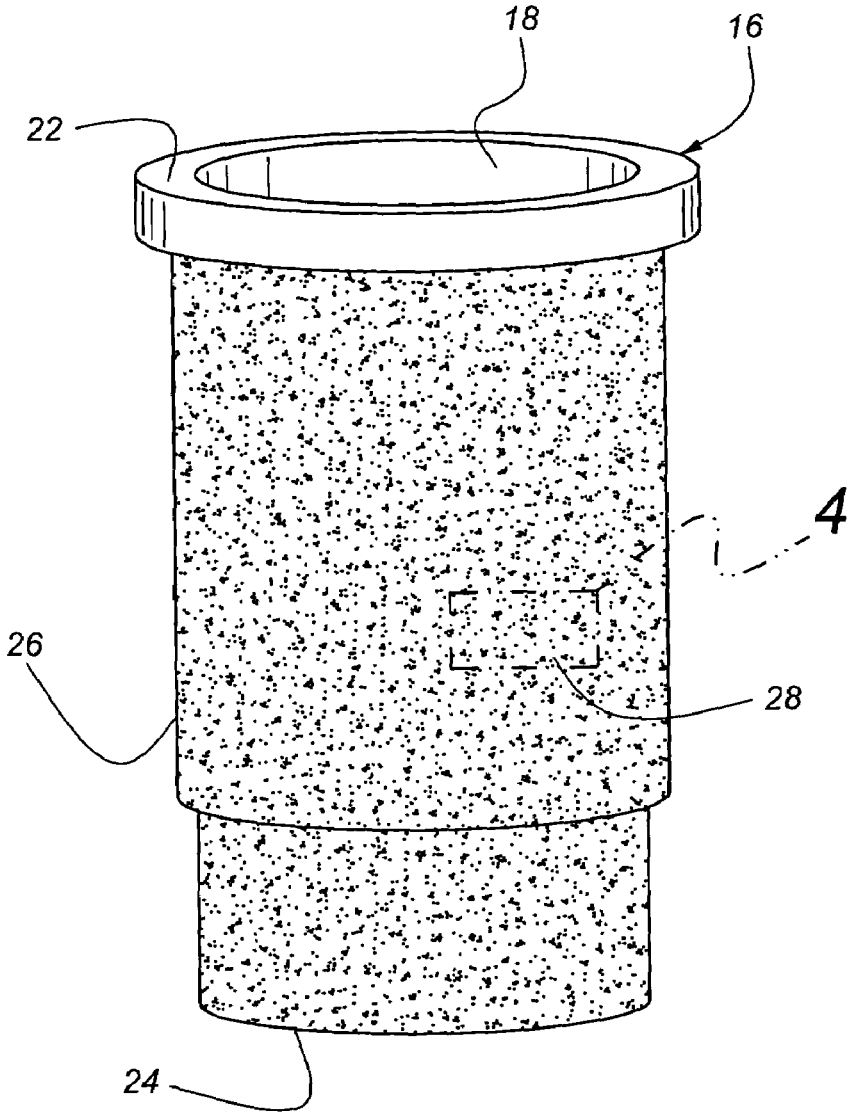
FIG. 3 is a perspective view of a cylinder liner according to the subject invention.

To protect the outer surface 26 of the cylinder liner 16, a surface texture 28 is formed over either the entire outer surface 26 or at least that section of the outer surface 26 which is most susceptible to cavitation-induced erosion. Quite often, the central portion of the outer surface 26 is most susceptible to cavitation-induced erosion because it undergoes the greatest displacement due to pressure fluxuations in the bore 18. In FIG. 3, the entire outer surface 26 is shown covered with the surface texture 28.

Figure 4:
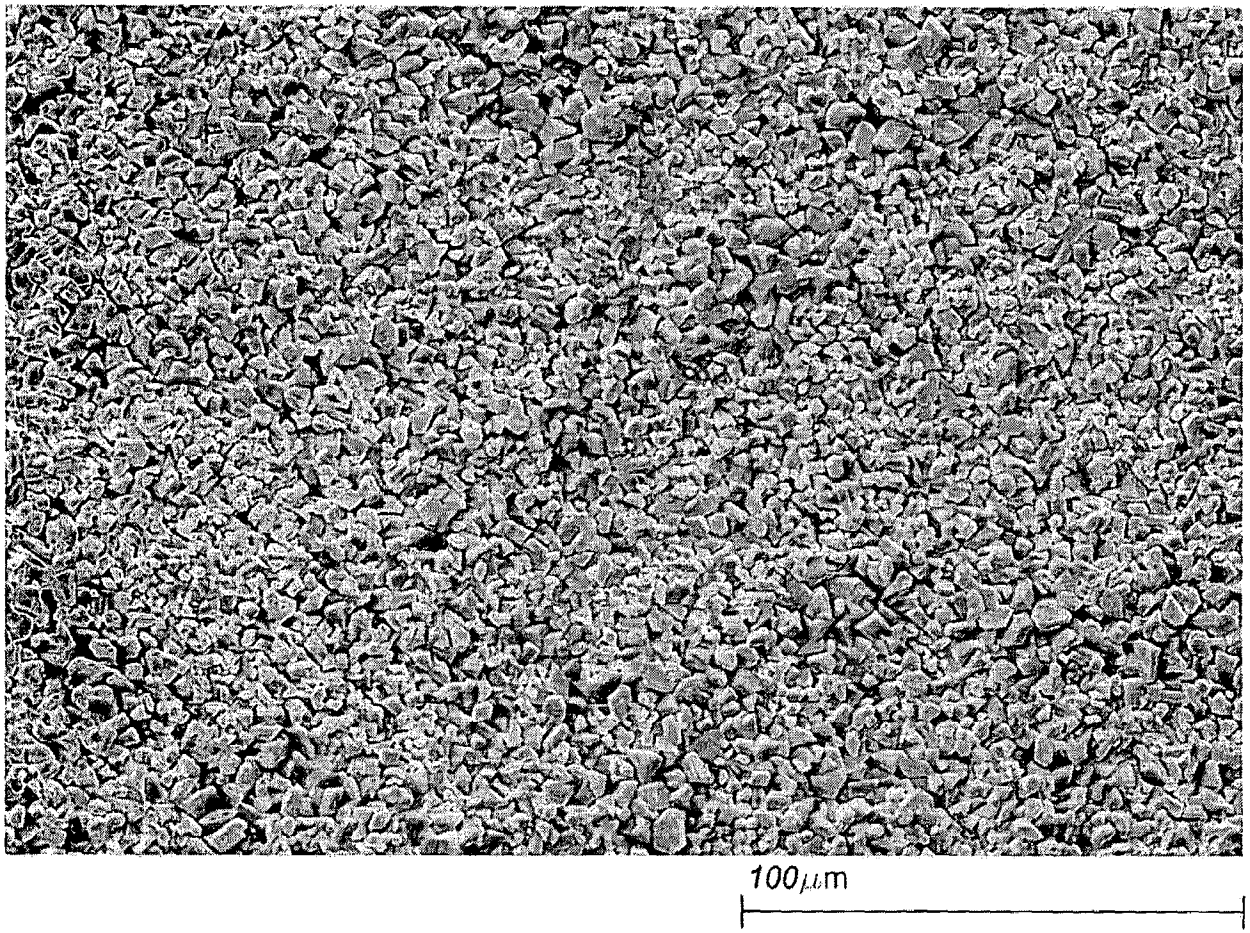
FIG. 4 is a micrograph representative of the appearance of the novel surface texture magnified approximately 1000×.
Figure 5:
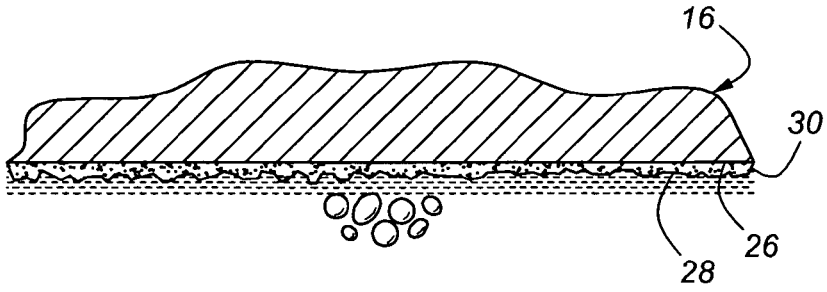
FIG. 5 is an enlarged, fragmentary cross-sectional view showing a portion of the cylinder liner and surface texture according to this invention, with cavitation bubbles being held at a spaced distance from the outer surface by a stagnant layer of liquid.

As best shown in the highly magnified FIG. 4, the surface texture 28 consists essentially of blocky particles having an average breadth and normal displacement of 2–8 μm. The crystal-like particles are each faceted and surrounded by a channel network giving the appearance, when viewed from a scanning electron microscope image enlarged 1000×, of a tightly packed array of aggregates, where each grain has several plane surfaces and the average grain size is between 2 and 8 μm. The dispersion of particles is generally random, but their tight packing results in an average maximum distance of less than 8 μm between adjacent particle grains. That is, the channel network, which is formed by the valleys between adjacent clustered crystalline particles, has an average maximum width of less than 8 μm.

The textured surface 28 is effective to intentionally create a very thin stagnant layer of liquid adherent to the outer surface 26. Typically, this layer of stagnant cooling liquid measures anywhere from 2–20 μm thick, depending upon the composition and viscosity of the cooling medium. At this order of magnitude ($10^{-6}$), adhesive forces strongly bind a liquid substance to a surface, especially if the liquid substance is polar in nature like water. Also at this magnitude, surface tension effects become very pronounced. Adhesion and surface tension effects are thus leveraged by the surface texture 28 and coupled to serve as capillary action. Thus, the cavitation bubbles are held by this stagnant layer away from the outer surface 26 of the liner 16. Moreover, the impinging jet from imploding cavities will have a longer path to travel and have to overcome the tenacious film formed by the stagnant fluid layer. This shielding action rapidly dissipates the incoming high kinetic energy from the imploding bubbles. If an imploding bubble breaches the stagnant layer, it is quickly healed and reconstituted within the cycle time needed to create a new cavitation bubble. The specific range of average particle sizes (breadth and displacement) of 2–8 μm, coupled with their tight spacing, enables the adhesion and surface tension effects within the liquid cooling medium to couple and act as capillary action to constitute the stagnant fluid layer about the outer surface 26.

The surface texture 28 can be formed upon the outer surface 26 of the cylinder liner 16 by any commercially available technique. For example, chemical or laser etching techniques can be used to form the surface texture 28, as well as mechanical grinding, stamping, rolling or abrasive blasting techniques. Preferably, however, the surface texture 28 is formed by a coating 30 composed of a material that is dissimilar to the material of the cylinder liner 16. Thus, while the cylinder liner 16 may be fabricated from a steel or cast iron (or other) material, the coating 30 can be a dissimilar material. This coating material can include manganese phosphate components which are suitably processed to act as a labyrinth which anchors the water molecules (or engine coolant) and thus promotes formation of the stagnant fluid layer. For example, one manganese phosphate based coating material may include Hureaulite, commonly described as $Mn_5H_2(PO_4)_4$-$4H_2O$. Hureaulite is a somewhat rare mineral with a chemistry that replaces one of the four oxygens in the regular phosphate ion group with a hydroxide or OH group.

In forming the surface texture 28 according to the manganese phosphate coating technique, the cylinder liner 16 will have its outer surface 26 prepared using standard practices known by the specific branches of the metals finish industry. However, the following modifications to such standard practices may be introduced. The liner 16 may be subjected first to an acid pickle stage, consisting of sulfuric acid at a concentration of 12–15% by volume and a maximum temperature of 38° C. Other acids can also be used, as the acid pickling is but a preferred route. Furthermore, a grain refiner stage is used at concentrations in the range of 0.3–0.8 oz/gal. The manganese phosphate bath should have a total acid/free acid ratio of no less than 6.5 with an iron content of 0.3% maximum. A warm (e.g. 50–70° C.) oil seal stage is used, preferably with a water soluble oil at 10–15% concentration by volume, to protect the cylinder liner 16 during shelf storage time.

The resultant coating 30, if analyzed by scanning electronic microscope at 1000× (FIG. 4), should exhibit a uniform structure consisting of 2–8 μm crystal (particle) size, blocky in nature, clearly faceted, with no "cauliflower"-like formations and a discernable channel network surrounding the crystals, i.e., the particles. Because manganese phosphate coatings of the type herein described have been used in industry for a long time, they have been proven to be very robust in the sense that they are reproducible. Secondly, the manganese phosphate coating process is a very inexpensive and environment-friendly process within the context of metal finishing processes.

Figure 6:
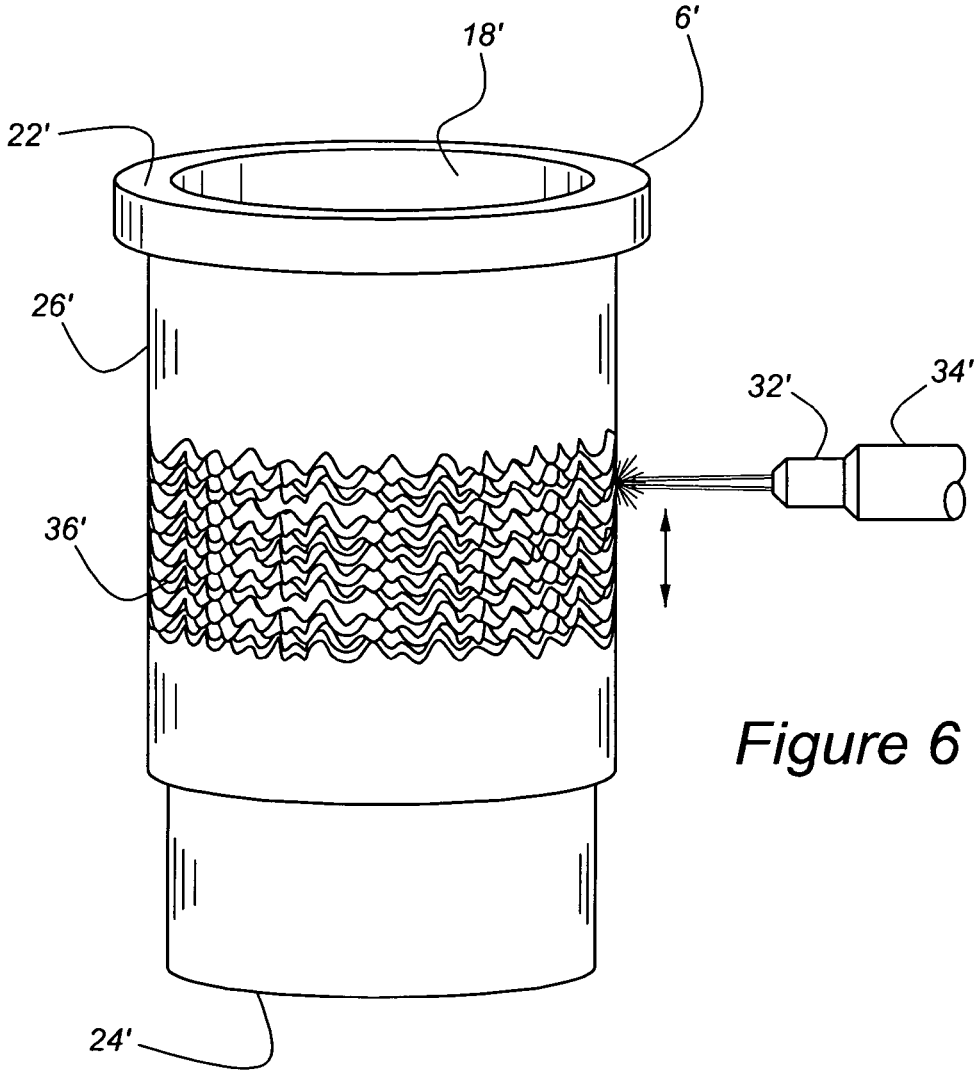
FIG. 6 is a perspective view of an alternative embodiment of the invention depicting a portion of the outer surface of the cylinder liner being treated with a laser beam.

FIG. 6 depicts an alternative technique for producing a cylinder liner 16' whose outer surface 26' is enhanced to better withstand the attack of cavitation-induced erosion. According to this embodiment, restricted local re-melting/chilling of the outer surface 26' is accomplished by a laser beam 32'. Here, an industrial laser 34' strikes the non-reflective outer surface 26' and thus generates a highly controllable melt/cool that, by virtue of the metallic substrate, acts as a heat sink and cools rapidly and as cast-chilled structure. The chilled surface results from the transformation hardening of the substrate material, and is highly scuff and fatigue resistant. Such re-melted/chilled metallic surfaces perform well under high hertzian stresses, which is exactly the fundamental mechanism eroding the typical cylinder liner under cavitating conditions. The radial depth of this chilled layer is typically between 20 and 200 μm and is created in situ on the cavitation-prone areas of the outer surface 26' of the liner 16'. It is entirely possible to modulate the laser 34' in such a way as to create treated patches 36' in lieu of an overall covering of the outer surface 26'.

Preferably, the laser 34' is of the $CO_2$ or ND:YAG or diode type. In operation, the cylinder liner 16' is affixed to a suitable, indexible jig (not shown) which has the provision to at least rotate the liner 16', and preferably also to translate the liner 16'. The laser 34' irradiates the outer surface 26' and generates a melt pool which quickly solidifies due the substrate action as a heat sink. The chilled structure results from this. Meanwhile, the rotation and transitory motions produced by the jig combine to generate re-melted bands that encompass the cavitation-prone zones, either as a continuous or patterned area 36'.

Obviously, many modifications and variations of the present invention are possible in light of the above teachings. It is, therefore, to be understood that within the scope of the appended claims, the invention may be practiced otherwise than as specifically described.

What is claimed is:

1. A cylinder liner for a liquid-cooled internal combustion engine, said cylinder liner comprising:

a tubular body having a generally cylindrical bore adapted for receiving a reciprocating piston and forming a portion of the chamber in which the thermal energy of a combustion process is converted into mechanical energy;

a upper end;

a lower end;

an outer surface enveloping said tubular body and extending between said upper and lower ends, at least a portion of said outer surface adapted for direct contact with a liquid cooling medium to transfer heat energy from said liner into the liquid cooling medium; and at least a portion of said outer surface including a surface texture consisting essentially of blocky particles having an average size of 2–8 μm, said particles being each faceted and surrounded by a channel network.

2. The cylinder liner of claim 1 wherein said tubular body is composed of a first material and said surface texture comprises a coating composed of a second material dissimilar to said first material.

3. The cylinder liner of claim 2 wherein said coating includes manganese phosphate.

4. The cylinder liner of claim 3 wherein said coating consists essentially of $Mn_5H_2(PO_4)_4$-$4H_2O$.

5. The cylinder liner of claim 1 wherein the maximum distance between adjacent ones of said particles is less than 8 μm.

6. A liquid-cooled cylinder block for an internal combustion engine, said block comprising:

a crank case including a coolant flow passage;

a cylinder liner disposed in said crank case, said cylinder liner having a generally tubular body defining bore extending between upper and lower ends thereof;

said body of said cylinder liner including an outer surface at least partially exposed to said coolant flow passage for transferring heat energy from said liner to a liquid cooling medium flowing within said coolant flow passage; and at least a portion of said outer surface exposed to said coolant flow passage including a surface texture consisting essentially of crystalline grains having an average size of 2–8 μm, said grains being each faceted and surrounded by a channel network.

7. The cylinder liner of claim 6 wherein said tubular body is composed of a first material and said surface texture comprises a coating composed of a second material dissimilar to said first material.

8. The cylinder liner of claim 7 wherein said coating includes manganese phosphate.

9. The cylinder liner of claim 8 wherein said coating consists essentially of $Mn_5H_2(PO_4)_4$-$4H_2O$.

10. The cylinder liner of claim 6 wherein the maximum distance between adjacent ones of said crystalline grains is less than 8 μm.

* * * * *